166-308. 5R 1-27-76 XR 3,934,649

United States Patent [19]

Pasini, III et al.

[11] 3,934,649

[45] Jan. 27, 1976

[54] METHOD FOR REMOVAL OF METHANE FROM COALBEDS

[75] Inventors: Joseph Pasini, III; William K. Overbey, Jr., both of Morgantown, W. Va.

[73] Assignee: The United States of America as represented by the United States Energy Research and Development Administration, Washington, D.C.

[22] Filed: July 25, 1974

[21] Appl. No.: 491,726

[52] U.S. Cl. ..... 166/254; 166/308; 166/314; 299/12

[51] Int. Cl.[2] ..... E21B 43/25; E21C 41/04

[58] Field of Search ..... 299/12; 166/271, 308, 314, 166/250, 254; 175/61

[56] References Cited

UNITED STATES PATENTS

| | | | |
|---|---|---|---|
| 3,313,348 | 4/1967 | Huitt et al. | 166/308 X |
| 3,384,416 | 5/1968 | Reuhl et al. | 299/12 X |
| 3,563,606 | 2/1971 | Sears | 175/12 X |
| 3,835,928 | 9/1974 | Strubhar et al. | 166/308 |
| 3,878,884 | 4/1975 | Raleigh | 166/308 X |

OTHER PUBLICATIONS

"Degasifying Before Mining" by W. M. Merritts Coal Age, Aug. 1961, pp. 74–78.

*Primary Examiner*—Ernest R. Purser
*Attorney, Agent, or Firm*—Dean E. Carlson; Richard A. Lambert

[57] ABSTRACT

A method for removing methane gas from underground coalbeds prior to mining the coal which comprises drilling at least one borehole from the surface into the coalbed. The borehole is started at a slant rather than directly vertically, and as it descends, a gradual curve is followed until a horizontal position is reached where the desired portion of the coalbed is intersected. Approaching the coalbed in this manner and fracturing the coalbed in the major natural fraction direction cause release of large amounts of the trapped methane gas.

8 Claims, 2 Drawing Figures

METHOD FOR REMOVAL OF METHANE FROM COALBEDS

BACKGROUND OF THE INVENTION

1. Field of the Invention

This invention relates to the extraction and recovery of methane gas from coalbeds containing the same, and more particularly to a method by which dangerous methane gas trapped in coalbeds beneath the earth's surface can be released and recovered by the drilling of boreholes from the surface.

2. Description of the Prior Art

As long as underground coal mining has existed, the danger of explosions from methane gas has created a hazard. The methane has been extremely difficult to remove from shafts as coal seams are followed underground. As a result as mining continues, the concentration of the methane gas within the mine has caused explosions which result in loss of life and usually, inability to proceed further with the mine in which the explosion occurred. While a great deal of work has been carried out in an effort to minimize the hazards of methane in coal mines, occasional methane explosions still occur. At the present time, three control techniques are considered to be useful for the elimination of methane from coal mines. These control methods are: (1) controlled dilution with air or ventilation of the mine; (2) blocking or diverting the gas flow in the coalbed by the use of adequate seals; and (3) the removal of pure or diluted methane through the use of boreholes.

The most widely used of these techniques is the introduction of ventilation air to reduce the concentration of methane to a safe level in the mine. It should be noted that the danger of methane explosion becomes a problem only when the concentration reaches dangerous levels. While work has progressed in the use of seals to divert the gas flow and boreholes to remove it, the general tendency of mine operators to date has been to continue to use ventilation or controlled air dilution techniques in order to avoid build-up of the methane gas.

A particular problem with ventilation of the mine concerns dust suppression. Dust suppression is a problem of great concern in mining because the dust is in many cases explosive and also causes respiratory problems to miners. Where methane is a serious problem, ventilation must be conducted in large volumes, creating higher velocity and this in turn, increases dust hazards because more dust is forced into suspension as well as greatly increasing ventilation costs. The present invention not only reduces the presence of methane at the working surface by predraining the same but also reduces dust suspension by decreasing volumes of air needed for dilution of methane. It further provides safer working conditions at less cost for power of fan operation.

The most recent work in this area has involved the removal of pure or diluted methane through boreholes drilled into the mine in order to fracture the coal and recover the methane liberated by the fracture. To the present time two methods of drilling boreholes have been utilized. In one method, the boreholes are drilled vertically from the surface above the mine so that the bits intersect the coal in a vertical manner. However, this method has not been satisfactory as it does not intersect with the major natural fracture direction so that large amounts of the methane gas are not liberated by this technique. These borehole techniques have been depended upon to work independently of each other and hence their effectiveness has been limited. In some instances, water has been flooded into one hole in order to force gas to migrate to another hole but this also has been only partially successful, due to the impermeability of coal. Various discussions of methods for the removal of methane gas may be found in the United States Bureau of Mines Information Circular 1973 entitled "Methane Control in United States Coal Mines — 1972", Information Circular 8600, United States Department of Interior.

Since the vertical borehole method has not been completely successful, substantial attention has been paid to the use of horizontal boreholes in order to intersect with the major natural fracture direction of the coal so that larger quantities of the methane gas will be released. However, the main drawback in drilling horizontal holes is that the drilling operation must take place within the mine and thus interferes with mining operations during drilling, risks possible blowouts of gas during drilling and/or piping operations, and makes collection of the gas a difficult operation. Thus, while the vertical drilling method for methane drainage is the lack of contact with the major, fracture system in the coal which results in low productivity wells requiring long periods of time to drain substantial volumes of methane, the horizontal method has also been unsuccessful because of the difficulty of carrying out the drilling operation.

It has also been proposed for example, at page 13, of the Bureau of Mines Information Circular 8600, identified above, to make use of socalled multi-purpose boreholes in order to effect methane drainage. A discussion of multi-purpose boreholes is also set forth in the publication "Coal Age", pages 50–52, Jan., 1973. The multi-purpose borehole is a system which uses a combination of vertical and horizontal boreholes. In this system, a ventilation shaft for a mine is drilled several years before the mining operation starts. Thereafter, horizontal holes are drilled from within the ventilation shafts. As can be appreciated, to drain the methane, use of this system requires long range planning as the mine must be planned long in advance. Moreover, the system is extremely costly to carry out.

In some of these systems, water may be infused into the mine or explosive charges selectively exploded in order to increase drainage of the methane from the mine. One technique of this type is set forth in U.S. Pat. No. 3,650,564.

Activity with respect to the recovery of methane gas from coal mines has particularly increased in recent years, not only to prevent explosions because of methane gas accumulation in the mine, but also in attempts to recover the methane gas to be used as a source of energy since methane, at least in pure form, is the same as natural gas which is used to heat and cool many homes and industries. Thus, there is a need in the art for methods by which methane gas can be liberated from the coal in large quantities and also recovered in a form which can be used as a source of energy. Accordingly, the present invention is concerned not only with minimizing the problem of explosions in mines where methane gas is found, but also in providing procedures for the recovery of valuable methane gas for use as a source of energy.

SUMMARY OF THE INVENTION

It is accordingly one object of the invention to provide a method for the liberation of methane gas from coalbeds in which methane is present.

A further object of the invention is to provide a method by which large quantities of methane gas can be extracted from the coalbeds by the use of one or more boreholes.

A still further object of the invention is to provide a method for extracting methane gas from coalbeds and recovery of the methane gas as an energy source.

A still further object of the present invention is to provide a method for the recovery of large quantities of methane gas from coalbeds which contain the same by procedures which are effective to reduce the danger of explosion in coal mines and provides means by which large quantities of methane gas may be recovered for use as a source of energy.

Other objects and advantages of the present invention will become apparent as the description thereof proceeds.

In satisfaction of the foregoing objects and advantages, there is provided by this invention a method for the liberation of methane gas from coalbeds and recovery thereof, which comprises drilling at least one borehole at a slant from the surface or at an angle deviating from the vertical, and descending at a gradual curve until the borehole is travelling in a horizontal direction when the drill bit forming the borehole intersects the coalbed. Also provided are methods for recovery of the methane gas through the borehole drilled into the coalbed.

BRIEF DESCRIPTION OF THE DRAWINGS

Reference is now made to the drawings wherein it will be seen that.

DESCRIPTION OF THE PREFERRED EMBODIMENTS

Figure 1:
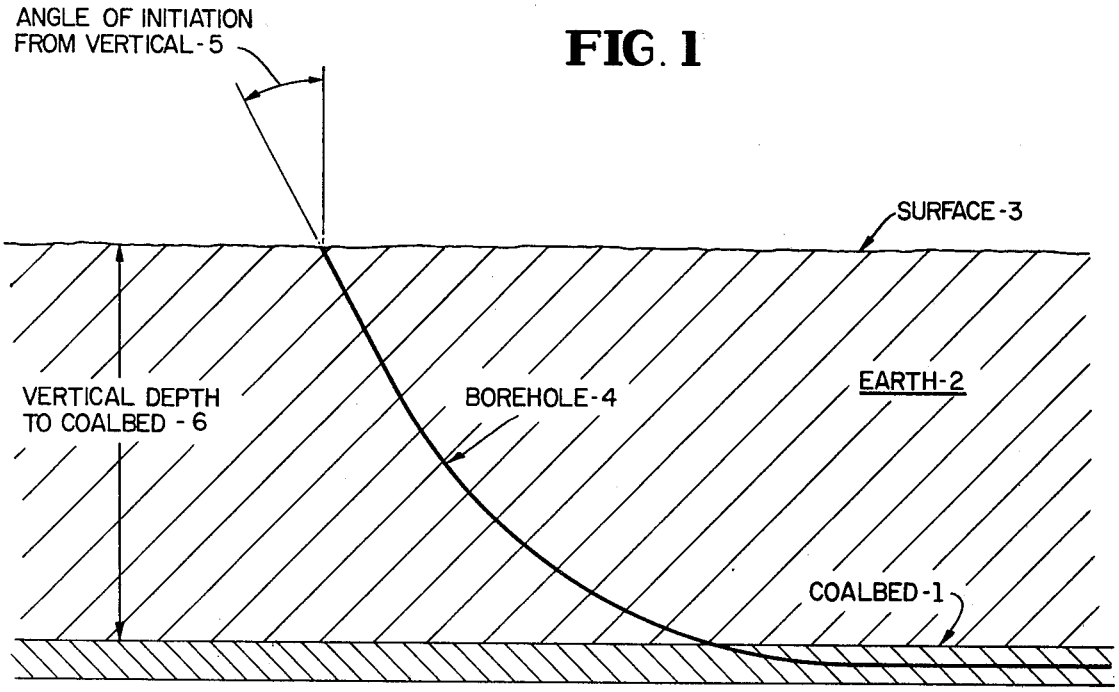
FIG. 1 represents a schematic illustration of one embodiment of directional drilling of well boreholes according to the method of this invention.

As indicated, this invention is concerned with methods for the extraction or liberation of methane gas from coalbeds and is particularly concerned with the use of directional drilling of wells or boreholes from the surface to a coalbed to effect drainage of the methane from the coal. This invention is also concerned with recovery of the methane gas through the wells or boreholes. In this invention, boreholes are directionally drilled from the surface of the earth above the coal into a coalbed in such manner as to intersect the largest number of joints possible and thus fracture the joints in the coal to remove large quantities of the methane prior to mining of the coalbed. The orientation of joints in a coalbed is in consistent directions with relatively uniform spacing in a particular sedimentary bed. This joint orientation or natural fracture system is utilized in the petroleum industry for the production of crude oil and natural gas. In the present invention, this natural fracture system is utilized in order to enhance the flow of methane from the fractures by intersecting as many of the vertical fractures as possible. Thus, by taking advantage of the natural fracture system or natural interconnection of the coal, and the well bore location with respect to the entire system, drainage of the methane formations above, below and within the coalbed can be accomplished. It is of course important that the direction of the joints be known in order to achieve maximum drainage efficiency and this is described hereinafter.

Prior to this invention, the only way by which the natural fracture system could be taken advantage of to release methane gas was by the use of horizontal drilling which had to take place in the mine. According to this invention, a unique drilling technique is utilized so that the natural fracture system can be used to release large quantities of the methane contained in the coalbed.

According to this invention it has been found that methane gas drains from a coalbed 3–10 times faster in the major natural fracture direction, that is, when the face cleats of eastern coal are intersected, than in the minor natural fracture direction or when the butt cleats are intersected. It was found that by intersecting or fracturing the face cleats with one or more boreholes which are directionally drilled from the earth's surface, the methane in the coalbed can be safely liberated and recovered and pumped into gas transmission or gathering lines for use as a source of energy without interference in the mining operations.

There are two essential requirements which must be recognized in order to take advantage of the theory of operation of this invention. The first involves the method of drilling the boreholes or wells from the surface of the earth into the coalbed. This involves initiating the borehole from an angle type drilling rig, preferably at some angle from the vertical plane to allow the borehole to reach the depth of coalbed quickly by travelling in a generally vertical direction. As the borehole descends however, it gradually curves toward the horizontal plane so that when the coalbed is intersected by the drill bit, it is travelling in a horizontal direction.

There are drilling systems commercially available which can be used to drill boreholes of this type. Accordingly, any desired type of angle drilling rig may be used. The wells or boreholes may also be drilled using tools capable of turning nearly ninety degree angles so as to go from almost vertical to horizontal. An apparatus of this type is disclosed in U.S. Pat. No. 3,398,804 where there is described a drilling rig for drilling a curved bore of predetermined radius of curvature from a main bore. This apparatus is particularly useful as it would provide a method by which the borehole could be drilled from a substantially vertical position and could turn a ninety degree angle in a short distance in order to intersect the coalbed at the proper horizontal level.

In drilling the borehole, it may be started at any desired angle from vertical so long as the drilling equipment will permit the borehole to be travelling horizontally when it reaches the coalbed. In general however, with conventional equipment, the angle of initiation will be determined by the depth of the coalbed and the dip of the coalbed. As a general rule, with conventional angle drill rigs, the angle of deviation should increase at a uniform five degrees per 100 feet of drilled hole for methane drainage.

A specific embodiment of the invention is illustrated in FIG. 1 accompanying this application. As shown in FIG. 1, it will be seen that in the view indicated, a coalbed 1 is shown as laying on a horizontal plane beneath the surface 3 of earth 2. The depth of the coal under the surface 3 is indicated at 6. In proceeding according to the present invention a borehole 4 is drilled from the surface 3 on a slant or at an angle of initiation 5 of some degree from vertical. The borehole continues generally on the angle of initiation until it nears the coalbed 1 at which time the borehole proceeds in a horizontal direction so that it intersects the coalbed while travelling in the horizontal direction. Thus the borehole intersects the major natural fracture system of the coalbed.

In the embodiment shown in FIG. 1, an angle of initiation of about 28° is sufficient for a coalbed depth of about one thousand feet. For a coalbed depth of about six hundred feet, an angle of initiation of about 54° is sufficient, while for a coalbed depth of about four hundred feet, an angle of initiation of about 68° is satisfactory.

It should also be understood that one or any number of boreholes may be directionally drilled into the coalbed to release the methane gas. Thus while the specific embodiment describes a single directionally drilled borehole or well, it is to be understood that the invention is not to be considered as limited thereto as sufficient boreholes should be used to liberate as much of the methane as possible.

The second major aspect of the invention is that it must be determined prior to drilling the direction of the major natural fracture of the coal, that is, in which direction on the horizontal plane should the borehole be travelling in order to intersect with the major natural fraction area. As indicated above, intersection with the major natural fracture direction is necessary in order that quantities of methane drainage be maximized. Therefore, proper application of the drilling technique described in this application depends on drilling of the boreholes in a compass-oriented direction so as to intersect the major natural fracture system and effect maximum methane drainage.

In coalbeds in the Eastern United States, the major natural fracture system is the face cleats. However, in the Western sub-bituminous coals, the major natural fracture system lies in the extension joints. Accordingly, it is required that the boreholes be drilled so as to intersect with the major natural fracture system whether working with Eastern or Western coals.

Figure 2:
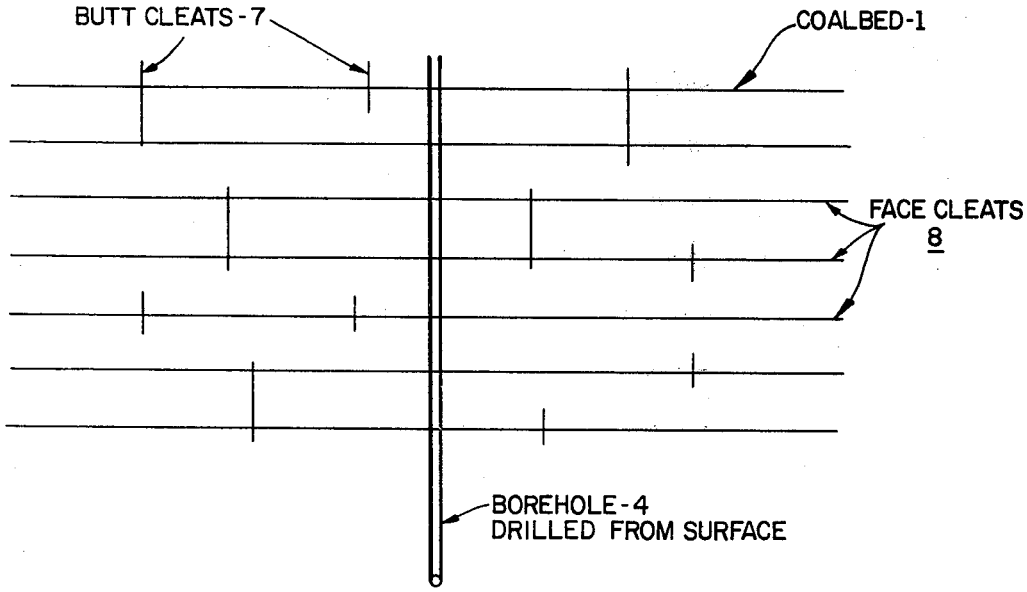
FIG. 2 illustrates the method of intersection of a bed of eastern coal and shows fracture of the natural fracture system of the coal.

In the specific embodiment shown in FIG. 2, it will be seen that there is illustrated a plan view of a coalbed of eastern coal which indicates the major natural fracture system and the minor natural fracture systems and shows how the borehole should intersect to effect maximum methane liberation. As shown in the drawing, the vertical lines indicate the presence of butt cleats 7 in coalbed 1 whereas the horizontal lines indicate the face cleats 8. As indicated, borehole 4 enters the coalbed and intersects face cleats 8 and thus intersects the major natural fracture system in this eastern coal to achieve maximum drainage of methane.

It is important that the borehole or boreholes intersect the major natural fracture area as shown in FIG. 2 or maximum methane liberation will not be achieved. Since the drilling occurs before the mine is started, the major natural fraction area must be determined prior to drilling as the direction of deviation of the borehole will be determined by the orientation of the natural fracture system of the coal. This fracture system controls the directional permeability of the coal and thus the preferential direction of flow of the liberated gases.

In an alternative embodiment of the present invention, after the boreholes are drilled and the fractures made, additional quantities of methane may be released by the use of hydraulic fracturing. In this embodiment, water is pumped under pressure through the boreholes to provide additional fracturing of the coal and thus create more passages for the methane gas to escape. Techniques for effecting hydraulic fracturing are described in the art including U.S. Pat. No. 3,650,564.

The directional properties of the natural fracture system of coal are its indicators. These directional properties include orientation of joint strikes, permeability, tensile strength, sonic velocity and inherent rock weakness. The result of such studies, together with geologic structure settings, will lead to a prediction of the gaseous flow path in the coalbed.

In making these determinations, oriented cores are first obtained, and upon receipt of an oriented core, individual pieces are placed in a goniometer and orientation marks scribed on the core. After each piece has been oriented, measurements are made of the orientations of the individual joint strikes that can be seen. Once the natural fractures are determined, their orientations are measured and frequency of occurrence summarized for the entire coalbed formation. Intervals of maximum fracture density may be regarded as zones of weakness which can be extended during stimulation of the coalbed. Specimens are then selected from various sections of the coalbed for measurements of permeability to gas in different directions. Permeability measurements are made in a Hassler cell, using whole core permeability techniques with dry nitrogen as the flow medium. Measurements are usually made in eight different directions, 22½° apart.

Ultrasonic pulse transit time measurements were made on the same specimens for which permeability is known. Measurements are made at atmospheric pressure using the through transmission arrangement of transducers. The mechanical pulse generated by a 2½ megahertz piezoelectric crystal transmitted diametrically through the test specimen at a pulse amplitude of 2,200 volts and detected by a receiver transducer provide the results. Interval travel time is recorded after 1,000 pulses are counted and averaged by a Hewlett Packard counter timer.

By these methods, the natural fracture system can be mapped in the subsurface so that both the orientation of the cleats and their directional flow paths can be utilized. It is emphasized that the present invention provides a number of advantages over the prior methods of effecting methane drainage. Thus, since the wells or boreholes are drilled from the ground surface they do not interfere with the mining operations and fewer persons are required in the mine than usually needed to drill horizontal holes. Moreover, explosion hazards are minimized during the drilling operation as the sudden outburst of methane will not be encountered, often a problem during horizontal drilling operations. Further, the collection of methane is more easily accomplished as manifold pipes are not required in the mine to collect the methane, since by the present invention it is collected at the surface through the boreholes. Furthermore, no special mine ventilation is required as would be necessary if the methane had drained from horizontal holes into the atmosphere of the mine. Therefore, the method of the present invention provides a number of advantages over prior practices in the drilling of boreholes and in extracting methane from coal mines.

What is claimed is:

1. A method for removing methane gas from underground coalbeds prior to mining the coal, which comprises determining the orientation of the major natural fracture system of the coalbed and directionally drilling at least one borehole from the earth's surface into the coalbed, said borehole being initiated at a slant and descending at a gradual curve until a horizontal position is reached as the borehole intersects the major natural fracture system of the coal, allowing the methane gas to be released, and recovering the methane gas from the borehole.

2. A method according to claim 1 wherein the major natural fracture system of the coal is the face cleats.

3. A method according to claim 1 wherein the major natural fracture direction of the coal is in the extension joints.

4. A method according to claim 1 wherein the methane is released by hydraulic fracturing of the coalbed.

5. A method according to claim 1 wherein a plurality of boreholes are drilled into the coalbed.

6. A method according to claim 5 wherein the borehole is initiated at an angle of deviation from the vertical and descends as a curved bore of predetermined radius of curvature until it intersects the coalbed in its major natural fracture system.

7. A method according to claim 6 wherein the angle of deviation from vertical of the borehole increases at a uniform five degrees per 100 feet of drilled hole.

8. A method according to claim 7 wherein the methane is released from each fracture made in the coalbed and is recovered at the surface of the borehole.

* * * * *